United States Patent [19]

Spindler

[11] Patent Number: 4,918,793

[45] Date of Patent: Apr. 24, 1990

[54] ZIP FASTENER AND A PROCESS FOR ITS MANUFACTURE

[75] Inventor: Siegfried W. Spindler, Schondorf, Fed. Rep. of Germany

[73] Assignee: Ries GmbH Bekleidungsverschlussfabrik, Fed. Rep. of Germany

[21] Appl. No.: 104,906

[22] Filed: Oct. 6, 1987

[30] Foreign Application Priority Data

Oct. 7, 1986 [DE] Fed. Rep. of Germany ..... 3634162

[51] Int. Cl.[5] ..... A44B 19/10; A44B 19/56

[52] U.S. Cl. ..... 24/392; 66/192; 66/195; 139/384 B; 156/73.2; 156/200

[58] Field of Search ..... 156/73.1, 73.2, 200; 425/814; 24/392, 393, 391, 395, 401; 66/192, 195, 202; 139/384 B

[56] References Cited

U.S. PATENT DOCUMENTS 3,482,290 12/1969 Uhrig ..... 24/392

3,540,084 11/1970 Fröhlich ..... 24/393

3,961,652 6/1976 Hasuda et al. ..... 24/393

4,492,098 1/1985 Heimberger ..... 24/392

FOREIGN PATENT DOCUMENTS 2179222 11/1973 France ..... 24/392

*Primary Examiner*—Michael Wityshyn

*Attorney, Agent, or Firm*—Sughrue, Mion, Zinn, Macpeak & Seas

[57] ABSTRACT

In a zip fastener comprising coupling member rows being formed of one continuous monofilament each, the coupling members of which consist of a folded S-shaped meandering profile, after conducting the according manufacturing process, the folded S-shaped meandering profile forming the coupling members of each coupling member row is connected in a weft thread manner with two strips of textile knitted fabrics forming a carrying tape, and the two strips of textile knitted fabrics forming the carrying tape are areally superimposed on each other with their leading edges being aligned.

8 Claims, 3 Drawing Sheets

ZIP FASTENER AND A PROCESS FOR ITS MANUFACTURE

Figure 1:
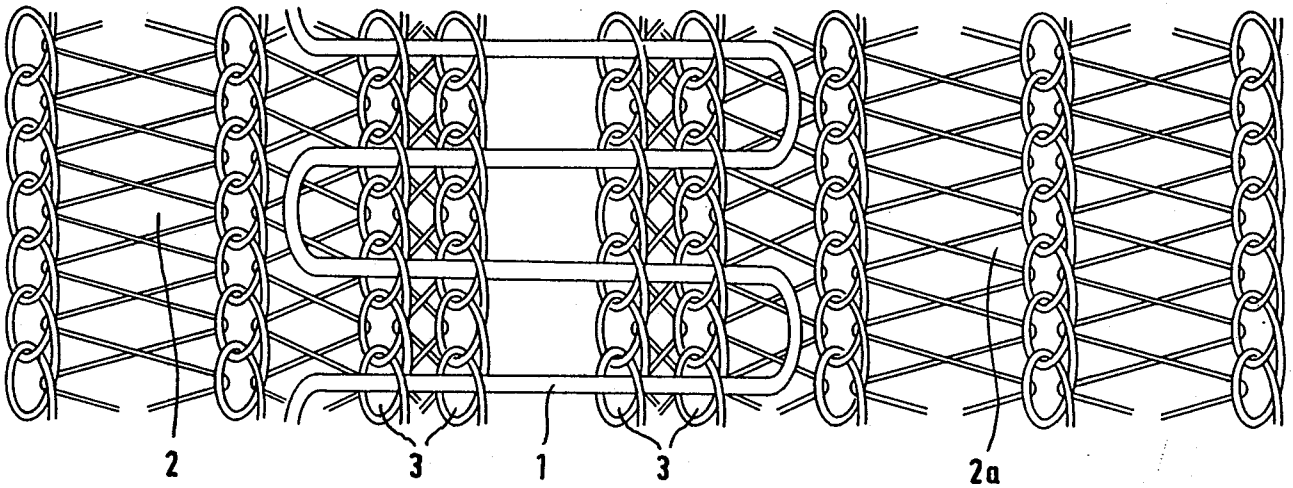

The invention relates to a zip fastener comprising coupling member rows being formed of one continuous monofilament each, the coupling members of which consist of a folded S-shaped meandering profile, as well as a process for the manufacture of such a zip fastener.

Zip fasteners, the coupling member rows of which consist of a continuous plastic strand, are conventionally manufactured such that the plastic strand (monofilament) is deformed to form a helical spiral or is made in the form of a longitudinally folded meander, is provided with coupling heads and is fastened on one carrying tape each for each side either by sewing or by weaving.

Furthermore, zip fasteners are known, the helical spiral of which is formed during the weaving process for the carrying tape strip in that the monofilament is introduced as weft thread (on a traditional shuttle loom).

In accordance with another process the helical spiral is produced on a needle loom, wherein the helical spiral is produced as an additional weft thread at the weaving point by winding around a mandrel. The result of this process are very functional zip fasteners but the critical working speed for economic operation of the looms is substantially reduced.

From German Utility Model DE-U-1 809 515 it has become known that for the production of the coupling member rows of a zip fastener, two woven strips each are being connected with each other by an S-shaped meandering profile in the form of a weft thread. After the folding on each other of the two narrow woven strips, the coupling member row which consists of said narrow woven strips and the meandering profile must then be fastened on a separate carrying tape.

It has furthermore become known that on a needle loom a monofilament can be placed as a warp thread between the short legs of a tape having a Y-shaped cross-section as a meander and that this monofilament should then be folded around its longitudinal axis. This zip fastener has the disadvantage that the coupling member row is only loosely suspended in the carrying tape and is not secured, which greatly reduces its functional capacity. In practice such zip fasteners have proven to be unusable.

A further disadvantage of all the known zip fasteners consists of the fact that the dyeing of the endless zip fasteners chains has to be carried out as a unit dyeing process - for example wound on bobbins or "bombers".

The economical continuous dyeing process which was developed for strip shaped textiles and is more favourable in terms of dyeing technology cannot be employed because the closing profile which is already connected with the carrying tape is deformed by the necessary nipping rollers between the dyeing chambers. These nipping rollers can moreover not be provided with recesses for the closing profile because otherwise dyeing liquor would be carried from one bath to the next one and the dyeing would be unreliable and uneconomical.

The invention is based on the object of creating a zip fastener of the type described initially as well as a process for its manufacture which avoid the disadvantages described above; in particular, the zip fastener should be capable of being produced especially rapidly and economically, it should have high functional capability and should allow the dyeing process to be carried out in continuous dyeing installations with nipping rollers.

This problem is solved according to the invention by a zip fastener of the type described initially in that the folded S-shaped meandering profile forming the coupling members of each coupling member row is connected in a weft thread manner with two strips of textile knitted fabrics forming a carrying tape, and the two strips of the textile knitted fabrics forming the carrying tape are areally superimposed on each other with their leading edges being aligned.

The two strips of textile knitted fabrics may have either identical or different widths.

Advantageously the two strips of knitted fabrics are connected with each other by sewing, bonding, or ultrasonic welding.

A process of the type described initially for the solution of the object in accordance with the invention is characterized in that the continuous monofilament is placed S-shaped as a weft thread on a crochet galloon, knitting, or Raschel machine in such a manner that it connects two knitted fabric strips forming a carrying tape, and the two knitted fabric strips are superimposed upon each other for the formation of the carrying tape by folding back the S-shaped monofilament along a longitudinal axis which extends between the knitted fabric strips Advantageously the monofilament is inserted on each of the two knitted fabric strips in respectively a plurality of adjacent loops.

The two knitted fabric strips together with the S-shaped monofilament can with especial advantage be dyed before being folded back in a continuous dyeing installation.

A further development of the process according to the invention includes that the two superimposed knitted fabric strips are connected with each other by sewing, bonding, or ultrasonic welding.

Figure 2:
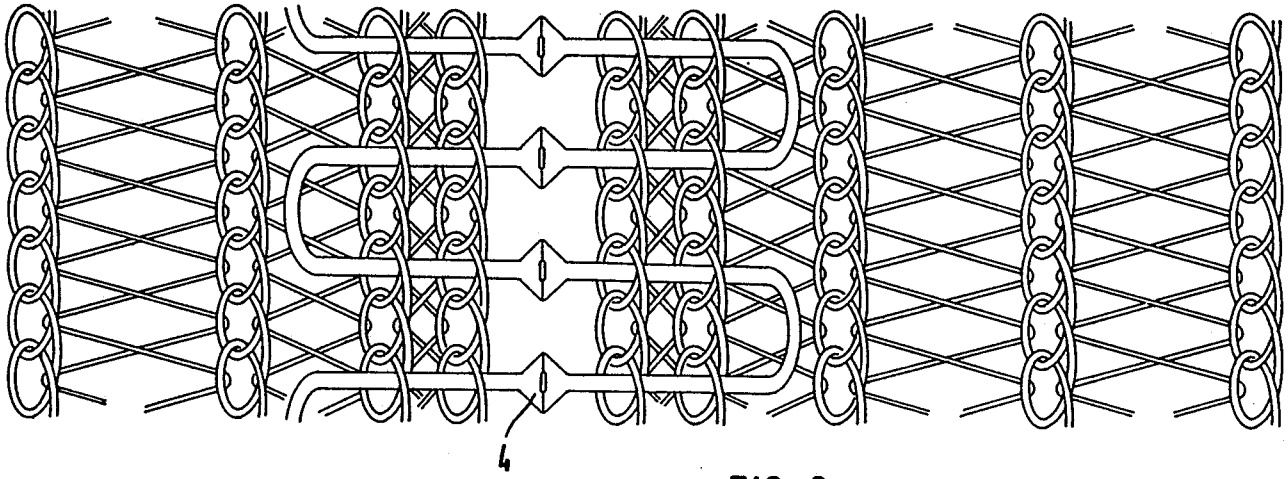
Figure 3:
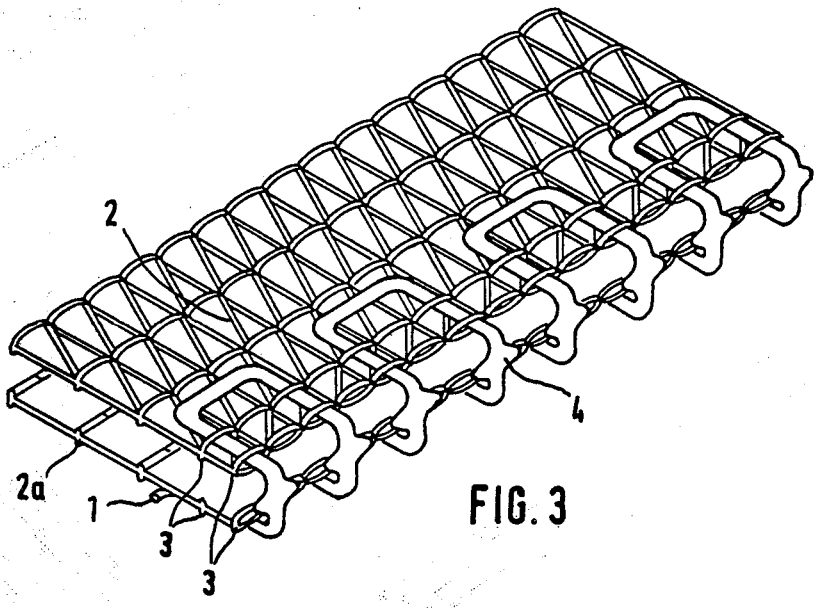
Figure 4:
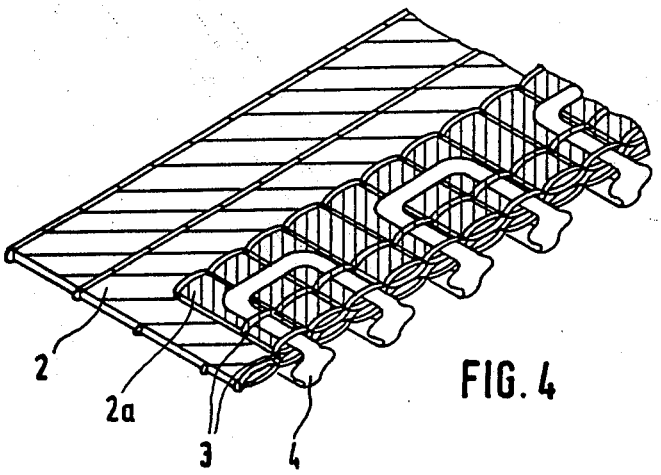

The invention is described in more detail below on the basis of embodiments and of the drawings. The drawings show:

FIG. 1 a plan view of a cut out of two textile knitted fabrics which are connected with each other by means of a S-shaped monofilament placed as a weft thread, FIG. 2 a plan view as in FIG. 1, with compressed enlargements of the monofilament in the center of the loop-free area, FIG. 3 a perspective view of a cut out of a zip fastener chain after the folding of the S-shaped monofilament with knitted fabric strips of identical width, and FIG. 4 a perspective view as in FIG. 3, but with knitted fabric strips of different widths.

The manufacture of the zip fastener according to the invention can be carried out on every suitable crochet galloon or Raschel knitting machine. A continuous monofilament 1 is introduced by means of a weft thread guide during the loop formation as a weft thread so that two knitted fabric strips 2, 2*a* which are formed by further textile weft and crochet threads are connected by said monofilament.

By suitable control of the thread guide a S-shaped flat meandering profile emerges as the connection of two knitted fabrics, wherein the monofilament is inserted in each of the two knitted fabrics into at least one loop 3, but preferably in a plurality of adjacent loops 3, and thus is firmly connected with the two knitted fabrics.

The thread guide for the monofilament moves from one stop to another, placing the monofilament as a weft thread into at least one of the still open loops on the marginal areas of the two resultant textile knitted fabrics and remains there until the completion of loop formation and the onward movement of the knitted fabrics in the working direction. Depending on the desired longitudinal division of the S-shaped meandering profile, the weft thread guide for the monofilament is withdrawn either on the next loop formation or only on a later loop formation to the point of departure, and thereby the monofilament is again inserted in the loops which are arranged in the marginal area of the two textile knitted fabrics.

The monofilament of S-shape which is disposed as the connection between two knitted fabric tapes is preferably compressed respectively in the middle of the loop-free area either by stamping or by raised pattern cylinders in a narrow area so that flattening of the cross-section and simultaneously an expansion 4 result transversely to the longitudinal axis of the monofilament. The S-shaped monofilament is either subsequently to or simultaneously with the raised pattern process bent back transversely to its longitudinal axis through 180° so that the raised pattern point is at the apex and the two knitted fabrics are superimposed.

The knitted fabrics can then permanently be connected with each other to form a carrying tape by heat treatment or by ultrasonic treatment or by other suitable measures.

Two such strips each form a zip fastener, the coupling members being formed by the legs of the folded S-shaped meandering profile and the carrying tapes being formed by the superimposed knitted fabrics.

Before the process of embossing and folding, the semi-manufactured product can be processed in the form of flat, strip-shaped knitted fabrics with a monofilament which is S-shaped and is also still flat without any problems in continuous dyeing installations.

Due to the fact that the carrying tapes are formed of two layers of knitted fabric each instead of one layer of woven fabric or knitted fabric for each side, as in the case of the known zip fasteners, no disadvantages arise with respect to the ecnonomy of the zip fastener according to the invention, because both the layers 2, 2*a* can be designed to be correspondingly wide-meshed. There results in fact the additional advantage that due to the enlarged mesh division when compared with a single-layer design by up to double the value, substantially stronger crochet needles can be used, with the corresponding positive effects on wear and tear, stability and operating speed.

In a further embodiment of the zip fastener according to the invention, the two textile knitted fabrics which are connected by means of the S-shaped monofilament are given differing widths. After the folding of the meandering profile, a double knitted fabric layer which supports the coupling member row results only in the marginal area of the carrying tape.

In this embodiment, the narrower knitted fabric strips must be securely connected with the broader knitted fabric strips, in order to avoid an unfolding of the coupling member row under stress. This can be achieved for example by a longitudinal seam or by bonding, for example by means of a thermoplastic substance, or by ultrasonic welding, to the extent that the knitted fabrics consist of thermoplastic yarn.

I claim:

1. A zip fastener comprising:

coupling member rows each comprised of a continuous monofilament connected to a carrying tape, said carrying tape being comprised of two strips of knitted textile fabric each having the loops of at least two wales adjacent one margin disposed in closely spaced relation to each other and the loops of the remaining wales being substantially spaced from each other with transversely extending yarns interconnecting adjacent wales and said continuous monofilament having an S-shaped configuration folded back upon itself along a center longitudinal axis to define two plies with the monofilament of each ply being knitted only into said closely spaced loops adjacent said one margin of each strip respectively with said one margins of said strips being disposed in superimposed alignment with each other adjacent said longitudinal axis.

2. A zip fastener as set forth in claim 1, wherein said monofilament is knitted into alternating loops of said at least two wales of each strip.

3. A zip fastener as set forth in claim 1, wherein said two strips of knitted textile fabric have different widths.

4. A zip fastener as set forth in claim 1, further comprising connecting means securing said two strips of knitted textile fabric to each other.

5. Process for the manufacture of a zip fastener comprising coupling member rows each comprised of a continuous monofilament connected to a carrying tape comprising:

knitting two strips of textile fabric each having the loops of at least two wales adjacent one margin disposed in closely spaced apart relation to each other and the loops of the remaining wales being substantially spaced from each other with transversely extending yarns interconnecting adjacent wales, inserting a continuous S-shaped monofilament into only said loops of said at least two wales during knitting with said one margins of said strips being disposed adjacent each other and folding said S-shaped monofilament back upon itself along a central longitudinal axis extending between said strips.

6. A process as set forth in claim 5, wherein said monofilament is inserted into alternating loops of said at least two wales of each strip.

7. A process as set forth in claim 5, further comprising interconnecting said strips by additional connecting means subsequent to said folding.

8. A process as set forth in claim 5, further comprising dyeing said strips subsequent to insertion of said monofilament and prior to folding of said monofilament in a continuous dyeing process.

* * * * *